US009314111B2

(12) United States Patent
Hartwell et al.

(10) Patent No.: US 9,314,111 B2
(45) Date of Patent: Apr. 19, 2016

(54) CONVERTIBLE CHILD CARRIER

(71) Applicant: BityBean LLC, Vergennes, VT (US)

(72) Inventors: Douglas A Hartwell, Vergennes, VT (US); James H Sadler, Huntington, VT (US)

(73) Assignee: BityBean LLC, Vergennes, VT (US)

( * ) Notice: Subject to any disclaimer, the term of this patent is extended or adjusted under 35 U.S.C. 154(b) by 48 days.

(21) Appl. No.: 14/033,278

(22) Filed: Sep. 20, 2013

(65) Prior Publication Data

US 2014/0084037 A1 Mar. 27, 2014

Related U.S. Application Data

(60) Provisional application No. 61/703,935, filed on Sep. 21, 2012.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
USPC ..... 224/159, 160
See application file for complete search history.

(56) References Cited

U.S. PATENT DOCUMENTS 4,037,764 A 7/1977 Almosnino
D253,135 S 10/1979 Fontana
D266,800 S 11/1982 Brunz et al.
4,436,233 A 3/1984 Hill et al.
4,467,945 A 8/1984 Schaapveld
D276,478 S 11/1984 Fallon
D286,227 S 10/1986 Ellis
4,724,987 A 2/1988 Maheu
D294,429 S 3/1988 Vasquez
4,757,925 A 7/1988 Knittel
4,778,091 A 10/1988 Barto
D306,655 S 3/1990 Schlegel Liebert
D315,981 S 4/1991 Onuwaje
5,020,709 A 6/1991 Hoaglan
D319,921 S 9/1991 Philipak
5,071,047 A 12/1991 Cordisco
5,205,450 A * 4/1993 Derosier ..... 224/161
5,246,152 A 9/1993 Dotseth
5,361,952 A 11/1994 Gold
D357,800 S 5/1995 Roan et al.
5,509,590 A 4/1996 Medeiros, Jr. et al.
D370,996 S 6/1996 Shimura et al.
5,522,528 A 6/1996 Petricola
D375,184 S 11/1996 Hickli et al.
5,570,823 A 11/1996 Lindy
D377,116 S 1/1997 Shimura et al.
5,609,279 A 3/1997 O'Shea (Continued)

*Primary Examiner* — Corey Skurdal
(74) *Attorney, Agent, or Firm* — Alan Cotè; Green Mountain Innovations LLC

(57) ABSTRACT

A child carrier worn on the back of a user for supporting and transporting a child includes a child seating and back support portion, an adjustable waist belt portion, two adjustable padded shoulder straps, a dual-adjustable cross-chest sternum strap, and two infant/child leg restraint straps. The child carrier is compliant to support the child from bottom, rear and side. The carrier may use shoulder and waist straps constructed of 3d air mesh fabric to provide adequate support and comfort, which enables the child carrier to be compressed into a small sack for stowage and transport in a pocket or other location.

20 Claims, 10 Drawing Sheets

(56) References Cited

U.S. PATENT DOCUMENTS

| | | | | |
|---|---|---|---|---|
| D378,872 | S | 4/1997 | Shimura et al. | |
| D385,105 | S | 10/1997 | Fair | |
| 5,690,258 | A | 11/1997 | Kataoka | |
| D388,247 | S | 12/1997 | McLauchlan | |
| 5,692,655 | A | 12/1997 | Fair et al. | |
| D395,161 | S | 6/1998 | Fair et al. | |
| D397,867 | S | 9/1998 | Fair et al. | |
| D403,852 | S | 1/1999 | Shimura et al. | |
| D409,373 | S | 5/1999 | Fair et al. | |
| 6,045,018 | A | 4/2000 | Onishi | |
| D425,696 | S | 5/2000 | Swanke | |
| 6,073,820 | A | 6/2000 | Drobinski | |
| 6,186,381 | B1 | 2/2001 | Kernkamp | |
| 6,247,755 | B1 | 6/2001 | Canna et al. | |
| 6,257,468 | B1 | 7/2001 | Yamazoe et al. | |
| 6,318,608 | B1 | 11/2001 | Fowler et al. | |
| 6,415,969 | B1 * | 7/2002 | Higuchi | 224/160 |
| 6,443,339 | B1 | 9/2002 | Higuchi | |
| 6,575,342 | B1 | 6/2003 | Sundara et al. | |
| D484,685 | S | 1/2004 | Kassai et al. | |
| 6,715,651 | B2 | 4/2004 | Le Gal | |
| D507,102 | S | 7/2005 | Bergkvist et al. | |
| D507,869 | S | 8/2005 | Liistro et al. | |
| 6,988,644 | B1 | 1/2006 | Asherbranner | |
| 7,168,600 | B2 | 1/2007 | Hwang | |
| D551,442 | S | 9/2007 | Nash | |
| 7,322,498 | B2 | 1/2008 | Frost | |
| D567,499 | S | 4/2008 | Elmberg et al. | |
| 7,389,897 | B2 | 6/2008 | Pistiolis et al. | |
| 7,472,964 | B2 | 1/2009 | King | |
| 7,484,645 | B2 | 2/2009 | Hoff et al. | |
| 7,517,011 | B2 | 4/2009 | Aliev | |
| 7,686,195 | B2 | 3/2010 | Bangert | |
| D614,861 | S | 5/2010 | Smyth et al. | |
| D615,750 | S | 5/2010 | Jones et al. | |
| 7,766,199 | B1 * | 8/2010 | Caperon | 224/160 |
| 7,770,765 | B2 | 8/2010 | Stevens et al. | |
| D623,401 | S | 9/2010 | Bergkvist et al. | |
| D623,402 | S | 9/2010 | Bergkvist et al. | |
| D632,887 | S | 2/2011 | Jones et al. | |
| 7,886,946 | B2 | 2/2011 | Gray | |
| 8,028,871 | B2 | 10/2011 | Gray | |
| D649,345 | S | 11/2011 | Bergkvist et al. | |
| D657,132 | S | 4/2012 | Caperon | |
| D664,351 | S | 7/2012 | Bergkvist et al. | |
| 2002/0011503 | A1 * | 1/2002 | Hwang | 224/160 |
| 2004/0238579 | A1 * | 12/2004 | Krogh | 224/160 |
| 2005/0045674 | A1 * | 3/2005 | Rehbein | 224/160 |
| 2005/0173479 | A1 * | 8/2005 | Gentil | 224/158 |
| 2009/0078729 | A1 * | 3/2009 | Coote | 224/161 |
| 2014/0014692 | A1 * | 1/2014 | Andren et al. | 224/161 |

* cited by examiner

CONVERTIBLE CHILD CARRIER

CROSS-REFERENCE TO RELATED APPLICATION

This application claims priority to Provisional Application 61/703,935, filed Sep. 21, 2012

FEDERALLY-SPONSORED RESEARCH

None

FIELD OF THE INVENTION

The present system relates to a child carrier, and more specifically, to a child carrier which enables a child to be carried in the posture of sitting in a chair, on the users back and to also be useable with the child on the front of the user, facing the user. The system enables transport of Infants/children between 8 pounds and 40 pounds in weight. The system also relates to the choice of construction materials and construction methods of this carrier that enable it to to be rolled and compressed into a small storage sack for efficient storage and transport when not in use.

BACKGROUND OF THE INVENTION

In general most soft child carriers are constructed of somewhat stiff and/or highly padded materials. In addition most provide highly padded shoulder straps and a wide and highly padded waist belt to support a portion of the child's weight. Such carriers provide adequate support and comfort but are not conducive to compressibility and portability due to their large size and bulky construction.

BRIEF SUMMARY

The system incorporates a child carrier worn on the back of the user for supporting and transporting a child including a child seating and back support portion, an adjustable waist belt portion, two adjustable padded shoulder straps, a dual-adjustable cross-chest sternum strap, and two infant/child leg restraint straps. The child carrier is compliant to support the child from bottom, rear and side. The carrier preferably uses shoulder and waist straps constructed of 3d air mesh fabric to provide adequate support and comfort, which enables the child carrier to be compressed into a small sack for stowage and transport in a pocket or other location.

BRIEF DESCRIPTION OF THE DRAWINGS

The above objects and other advantages of the present system will become more apparent by describing the preferred embodiments thereof in more detail with reference to the accompanying drawings in which.

DETAILED DESCRIPTION

To solve the limitation as described in the Background section, it is an object of the system to provide a child carrier that is designed to be highly compressible and portable.

It is another object of the present system to provide a child carrier that enables a child to sit be comfortable and close to the caregiver, allowing freedom of movement for the arms of the child It is still another object of the present system to provide a child carrier that alternately carries a younger child on the caregiver's front, with the child and caregiver facing one another.

Figure 1:
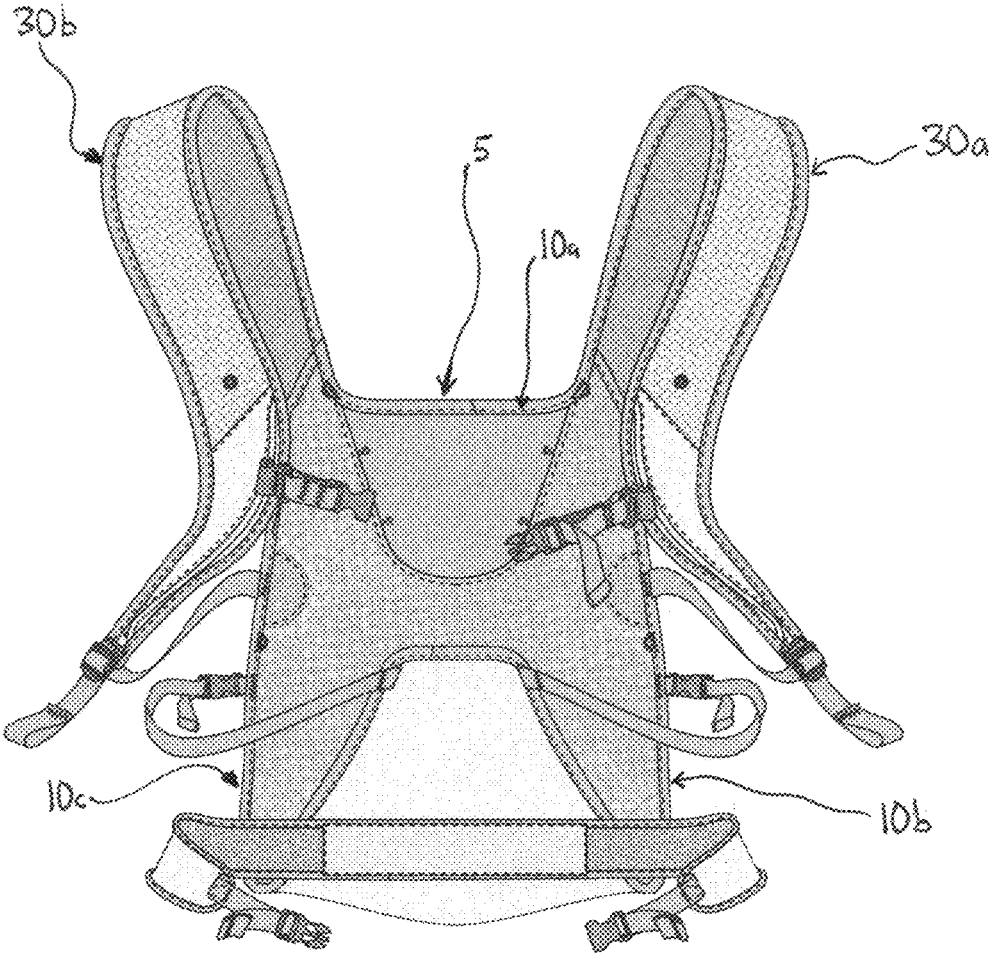
FIG. 1 is a front elevation view of the child carrier.
Figure 2:
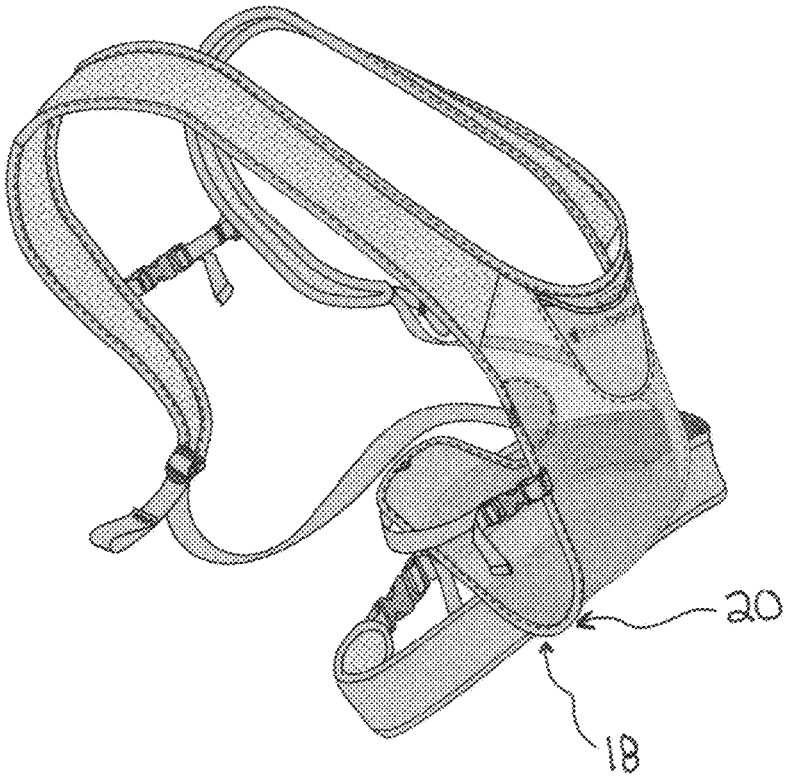
FIG. 2 is a rear perspective view thereof.
Figure 3:
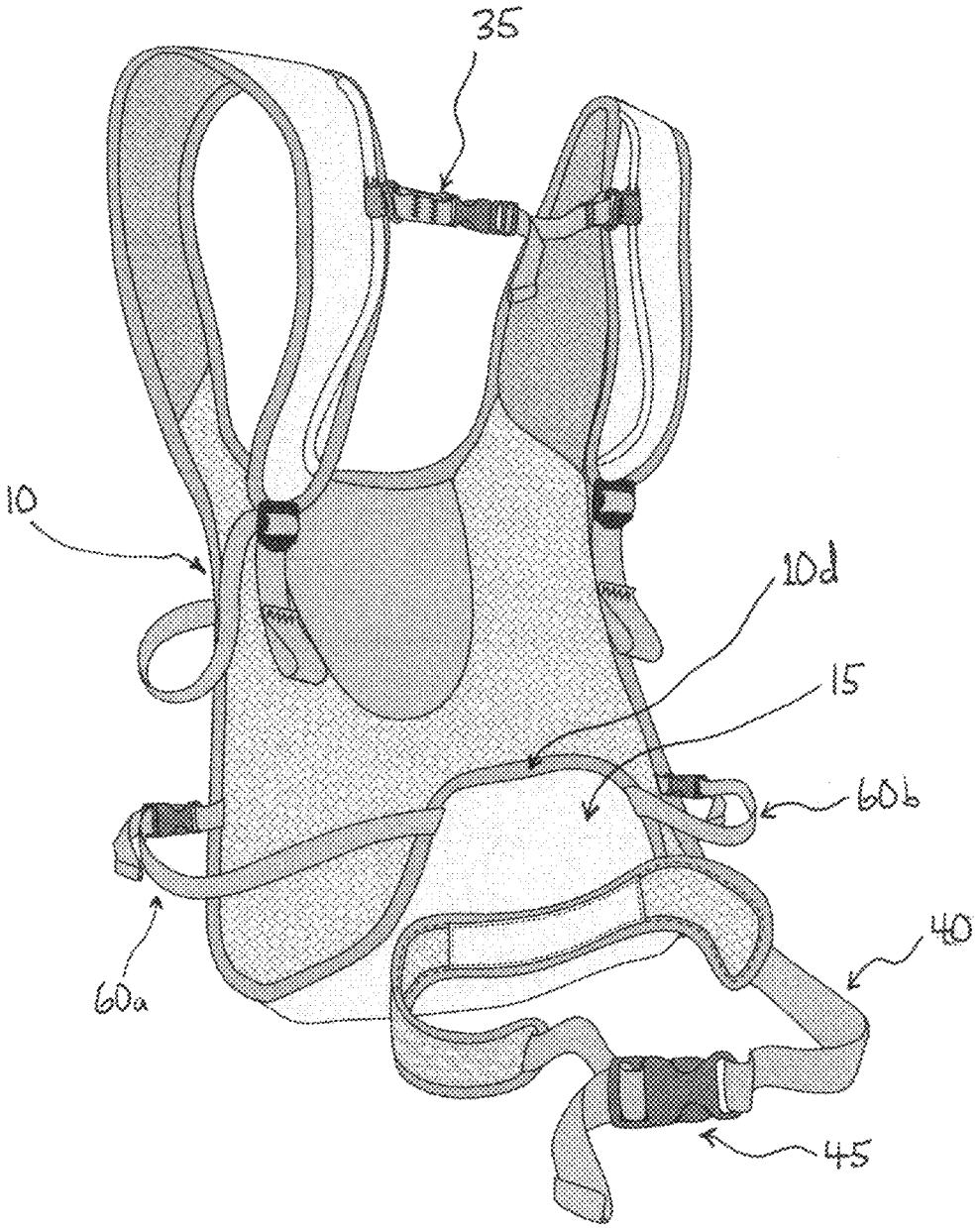
FIG. 3 is a front perspective view thereof.

To accomplish this and other objects, the child carrier, best referenced in FIG. 1, FIG. 2, and FIG. 3, according to the present system includes a flexible fabric body panel (5) that supports the child from the rear and bottom. In the preferred embodiment, the body panel is constructed of one layer of strong support fabric of ripstop nylon or equivalent, and one layer of breathable lightweight mesh fabric for comfort.

Body panel (5) includes two separate portions. The first portion is upper portion (10), which includes an upper edge (10*a*), right edge (10*b*), and left edge (10*c*). The second portion of body panel 10 includes a lower hip portion (15). Lower hip portion (15) is approximately trapezoidal in shape, with a taper that gradually creates a narrow width than the full width of body panel (5). The narrowest part of lower hip portion (15) is at lower edge (10*d*).

Upper portion (10) and lower portion (15) are preferably constructed from a single piece of fabric, however multiple pieces may be joined together to create the entire body panel, with joints either at the junction (18) of the upper and lower portions, or elsewhere. In the preferred embodiment, the lower portion curves relative to the upper portion at approximately 180 degrees along fold (20).

The child carrier includes a right shoulder strap (30*a*) and a left shoulder strap (30*b*). The upper end of each shoulder strap is attached to the upper edge of the body panel (5), near the intersecting point with right edge (10*b*) and left edge (10*c*) respectively. The lower end of each shoulder strap connects to right edge (10*b*) and left edge (10*c*) respectively. The shoulder straps are formed in an S-curve shape and are primarily constructed of 3d air mesh type fabric, which preferably is slightly stretchable. The shoulder straps include length adjustability, and also a sliding and adjustable sternum strap (35) that connects the shoulder straps together in the front of the caregiver, across the upper sternum, or across the back for the front carry position.

The child carrier further includes a hip belt (40), which attaches to body panel (5), and is preferably constructed of 3d air mesh type fabric. Each end of hip belt (40) is connected around the user with adjustable narrow straps and a buckle (45), with the buckle adjustable and separable. Belt (40) and body panel (5) preferably connect at fold (20); specifically, the belt is attached to the lower portion (15) of body panel (5), immediately adjacent to fold (20). Thus, body panel (5) does not end at belt (40), but rather continues past belt (40) in the form of lower portion (15). This configuration creates a load path (which will be further described later) that pulls down on the bottom of the hip belt (40), and also maintains a flat hip belt against the body of the adult. Thus, a more comfortable hip belt is created without the use of wide, stiff, or heavily padded materials.

In the preferred embodiment, belt (40) is sewn to body panel (5), though other means known in the art such as riveting, bonding, etc. could be used. Belt (40) is not sewn edge-to-edge to the full width of body panel (5), rather the belt is sewn only to a fraction of the full width of body panel (5). This can be seen in FIG. 1, where the dashed lines, forming a rectangular shape, represent the stitching of belt (40) to the body panel (5). Here, the vertical side stitches are clearly seen as creating a union more narrow than the full width of body panel (5), even as the sides of lower portion (15) is tapering in its trapezoidal shape.

Figure 4:
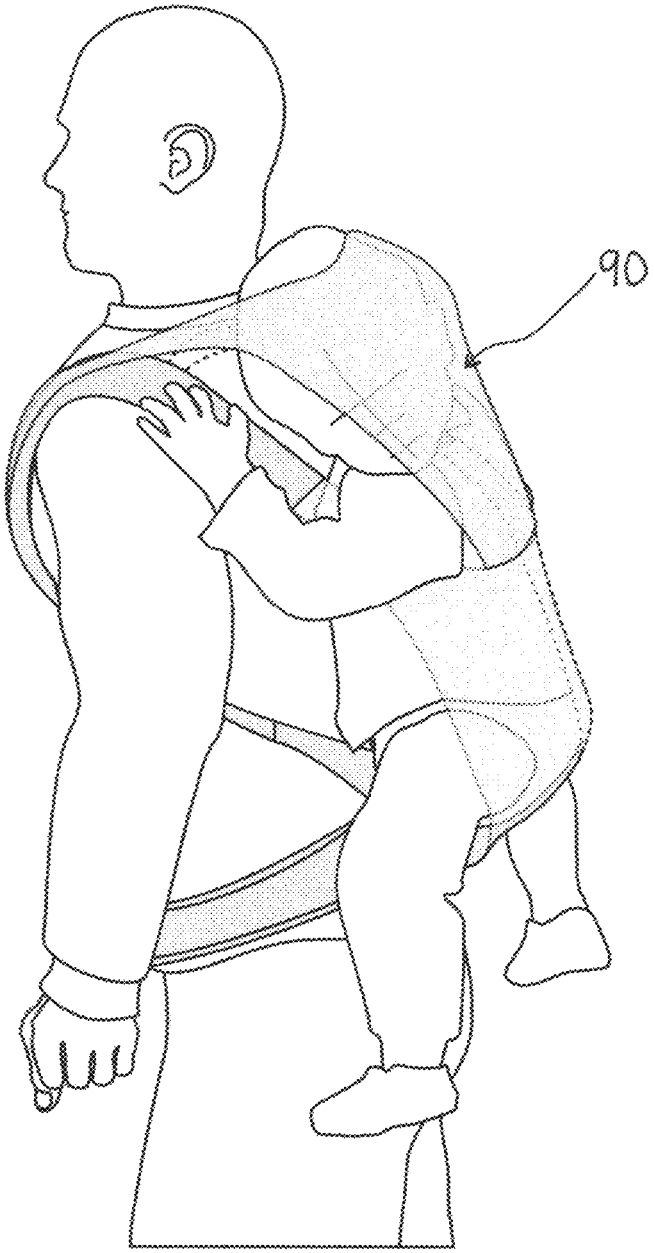
FIG. 4 is a rear perspective view, showing the child carrier would be worn by an adult on the back, with leg restraints detached, and a hood inplace.
Figure 5:
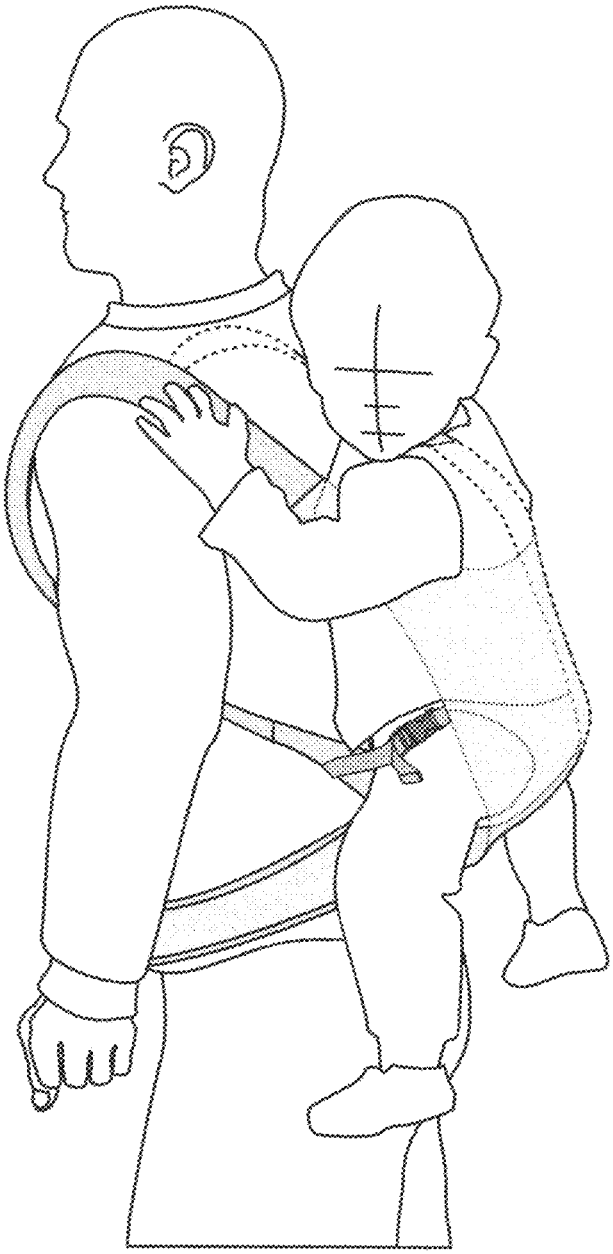
FIG. 5 is a rear perspective view, showing the child carrier would be worn by an adult on the back, with leg restraints attached, and no hood.
Figure 6:
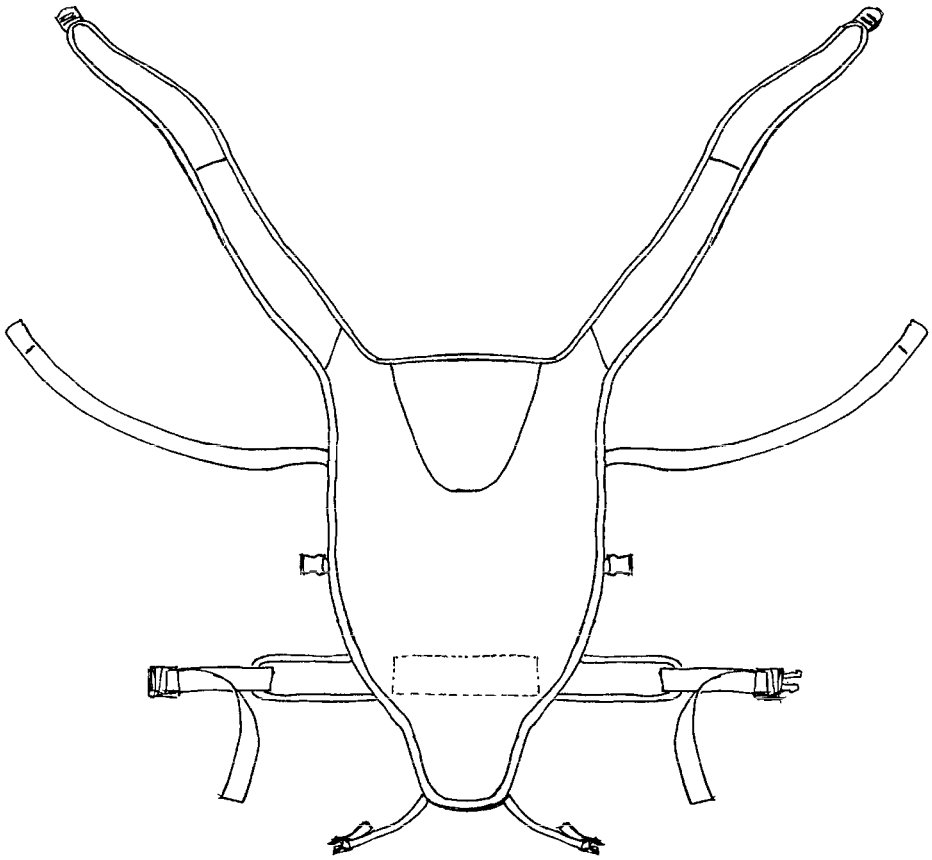
FIG. 6 is a flat layout view of the child carrier, with straps unfastened.
Figure 7:
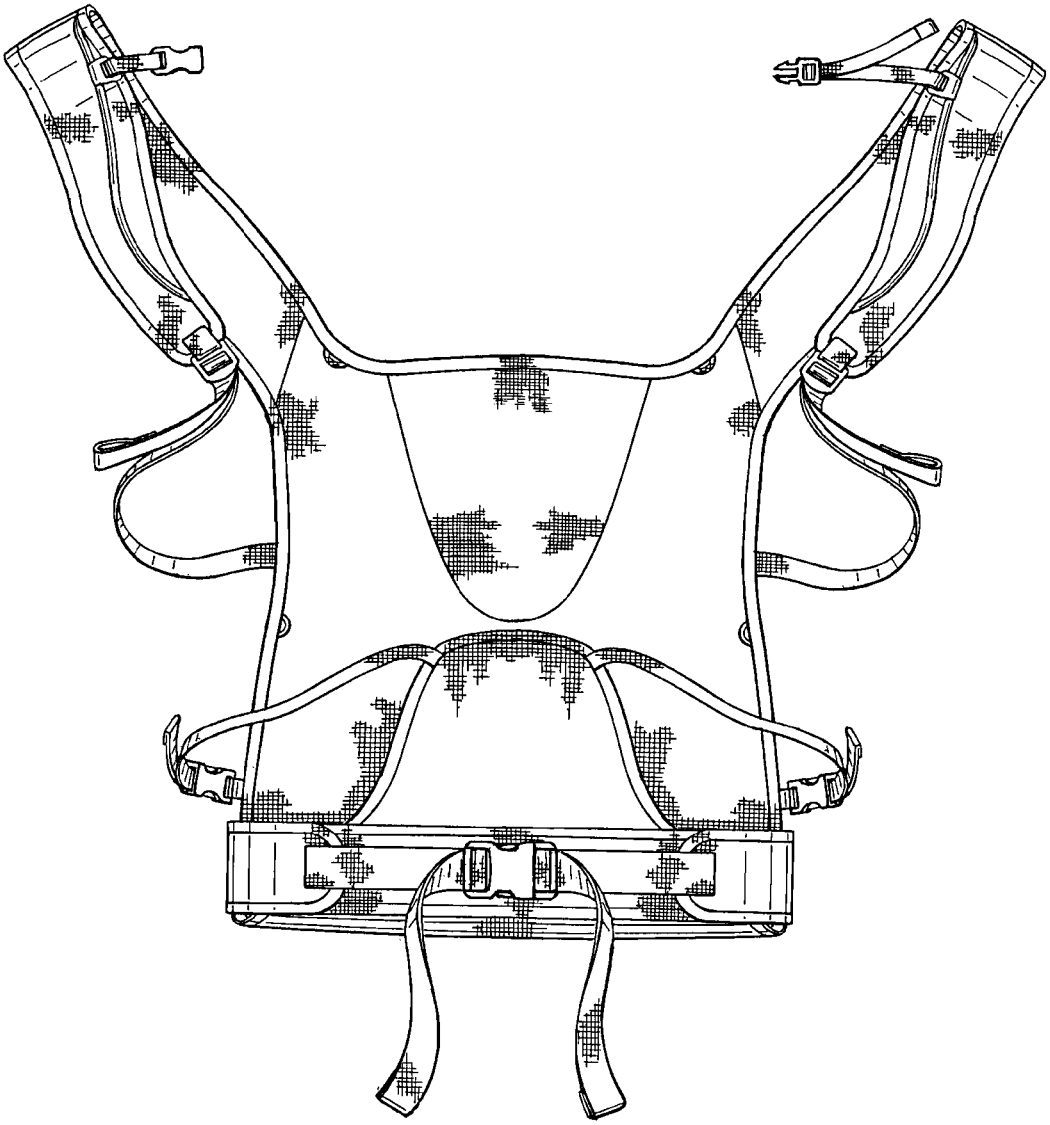
FIG. 7 is an additional front elevation view of the child carrier.
Figure 8:
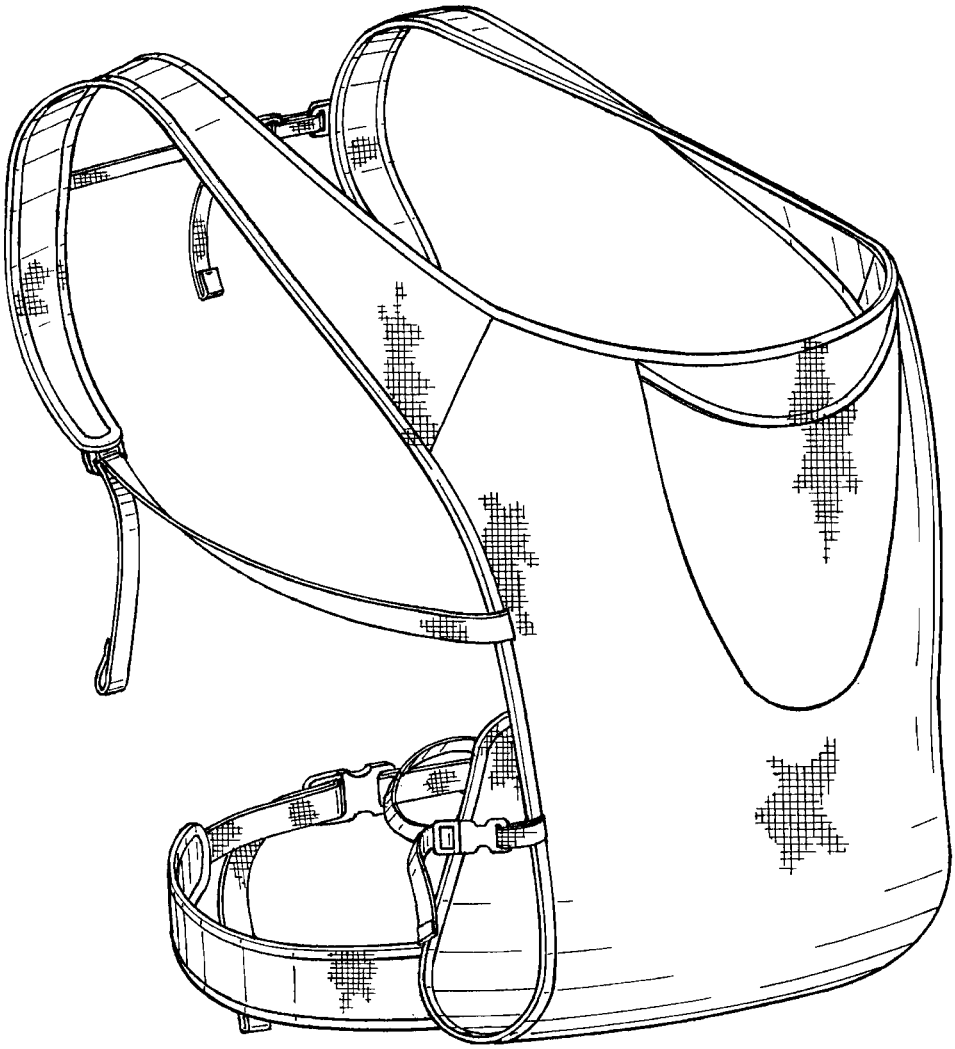
FIG. 8 is an additional rear perspective view of the child carrier.
Figure 9:
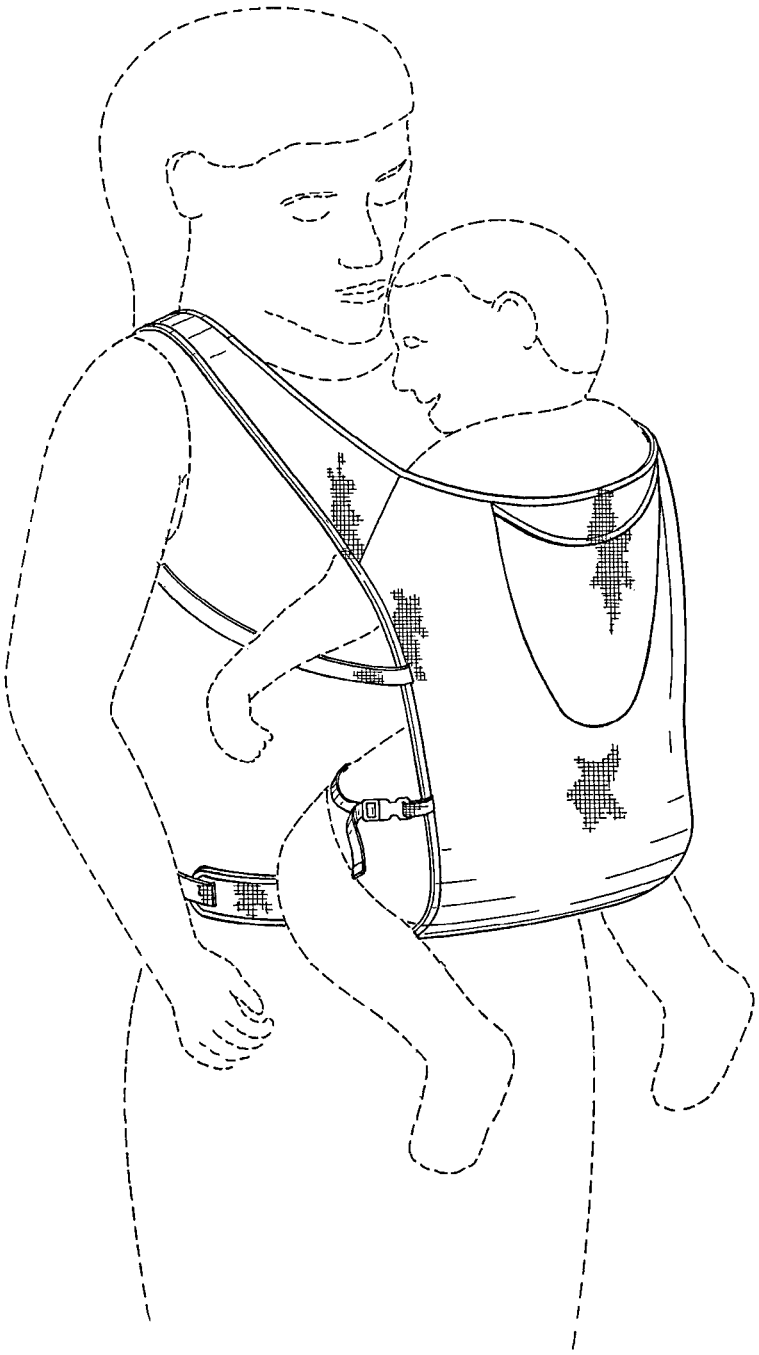
FIG. 9 is front perspective view, showing the child carrier would be worn by an adult on the front, with leg restraints attached.

Further features of the system include left restraint strap (60*a*) and right restraint strap (60*b*). As seen in FIG. 4, the carrying system may be configured detached to body panel (5). In this arrangement, an enlarged sized opening (as compared to the restraint straps configured attached to body panel (5), as will be further explained) is created for a child's legs. When right and left restraint tabs are configured attached to body panel (5), as seen in FIG. 5, a reduced sized opening is created for a child's legs. Thus, when carrying a younger, smaller child, the straps may be attached to create a smaller leg opening. When the child is older and larger, the system may be configured with the restraint straps detached, to create a larger opening, corresponding to the larger size of an older child's legs.

Restraint straps 60*a* and 60*b* bridge between the shoulder straps and the mid portion of the body sheet via adjustable buckles. Here, the size of the leg opening for a child is further enabled by lower hip portion (15). With the restraint straps attached, as seen in FIG. 1-3, lower hip portion (15) is positioned between the body of the child and the body of the adult, wrapping between the child's legs. With the restraints straps detached, as seen in FIG. 5, the lower hip portion (15) unobtrusively tucks underneath the child's bottom, with its exact position not relevant in this configuration.

The pack is configured to be used either on the back or on the chest of an adult, where an adult means any appropriately aged and sized person suitable to give care to a child who may appropriately fit in the carrying system. The child system may be used by various shapes and sizes of caregivers, and children, with a stated age limit and weight limit, through adjusting attachment straps. The system being convertible between front and back carrying positions creates additional benefits compared to a front-only or back-only system. A front carry position may be best suited to babies and small children, which provides better parent-child interaction, and also may enable breastfeeding during wear. As a child ages and is more suited to carrying on the adult's back, which is typically more comfortable than carrying on the adult's front, there is no need to purchase a new carrying system.

FIG. 4 also shows optional hood (90), an approximately trapezoid shaped sheet with a top edge, a bottom edge and two side edges. The side edges include elastic sewn in to provide gentle support for a child's head. The bottom edge has two tabs of lightweight webbing which are attached via snaps through either of two sets of attachment loops to an optional pocket on body panel (5). Different Loops may be used depending on the size of the child (upper loops being for larger children, lower loops for smaller children). The top edge has attached two lengths of lightweight webbing with snap sides along its length, and attach to the snap sides installed in the shoulder straps 30*a* and 30*b*.l A number of snaps along its length provide for adjust ability. The hood can be stowed inside the pocket when not in use. The hood may serve to give the child added comfort, light head support, or shelter from the elements.

Figure 10:
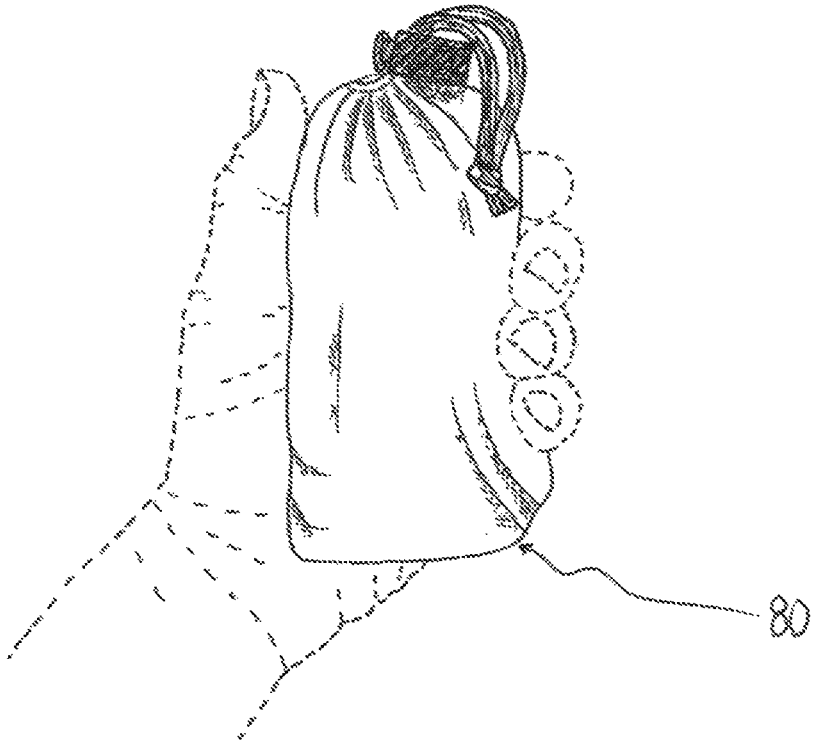
FIG. 10 is a view showing the child carrier is compressed and packed for stowage.

The system is of a minimalist design, and along with the choice of fabric materials and construction techniques, allows the child carrier to be rolled and compressed into a small state, allowing convenient and efficient packing and storage. This enables the child carrier to be carried at present within a purse, basket or diaper/travel bag. When rolled into a compact form, the carrying system may be placed inside a cylindrical sack (80), as seen in FIG. 10, that measures seven inches long by three inches in diameter, or seven inches by three inches by three inches.

The system also creates a preferred load path along the length of body panel (5). A child's weight, or load, slightly stretches the fabric material of body panel (5) to distribute load forces across the child's back and hips, and pull the child close to the parent, for closeness, comfort, and stability. The system also creates a load path, between the right and left shoulder straps and the hip belt, that does not coincide with the edge of body panel (5). This is accomplished with a wide body panel (5), which places the load path on the inward portion of body panel (5), away from right edge (10*b*) and left edge (10*c*). There is also evidence that the configuration better distributes the pressure on a child's legs, thereby reducing red marks caused by a tensioned fabric edge "digging-in" to the child's legs as with to other carriers. Further, the system provides knee-to-knee support for infants, and may reduce hip dysplasia and uncomfortable pressure in a child's groin area.

FIGS. 6, 7, 8, and 9 provide additional views of the carrying device.

Although the present invention has been described with respect to one or more embodiments, it will be understood that other embodiments of the present invention may be made without departing from the spirit and scope of the present invention. Hence, the present invention is deemed limited only by the appended claims and the reasonable interpretation thereof.

What is claimed:

1. A device for carrying a child, comprising:

a flexible fabric body panel with an upper portion including an upper edge, a right edge, a left edge, and a trapezoidally shaped lower hip portion which includes a lower edge opposed to said upper edge, said lower hip portion tapered such that said lower edge is narrower in width than said body panel;

a junction of said upper portion and said lower hip portion defined by a fold, said fold being approximately 180 degrees;

a hip belt, fixably attached to said body panel, that encircles an adult wearer's waist, with an adjustable separable buckle, said hip belt fixably attached to a fraction of said trapezoidally shaped lower hip portion's width between said right edge and said left edge, area of said fixable attachment being approximately rectangular in shape and positioned immediately above said fold; a right shoulder strap, with one right shoulder strap end joined to said body panel near an intersecting point of said upper edge and said right edge, and another right shoulder strap end adjustably joined to said right edge;

a left shoulder strap, with one left shoulder strap end joined to said body panel near an intersecting point of said upper edge and said left edge, and another left shoulder strap end adjustably joined to said left edge;

a right restraint strap, with one right restraint strap end attached to said lower hip portion's lower edge, and another right restraint strap end removably and adjustably attached to said body panel's right edge;

a left restraint strap, with one left restraint strap end attached to said lower hip portion's lower edge, and another left restraint strap end removably and adjustably attached to said body panel's left edge.

2. The device of claim 1, in which the device may be worn on an adult's back or an adult's front.

3. The device of claim 1, which further includes a removable hood attached to said body panel.

4. The device of claim 1, further including a sternum strap that removably and adjustably connects said right and left shoulder straps together.

5. The device of claim 1, in which at least a portion of said right and left shoulder straps are made from stretchable, 3d woven fabric.

6. The device of claim 1, in which at least a portion of said body panel is made from stretchable, 3d woven fabric.

7. The device of claim 1, in which the device is packable into a sack with a substantially cylindrical shape and dimensions not greater than seven inches by three inches by three inches.

8. The device of claim 1, in which said right and left restraint straps serve to create a reduced sized opening for a child's legs by being configured attached to said body panel.

9. The device of claim 1, in which said right and left restraint straps serve to create an enlarged sized opening for a child's legs by being configured detached to said body panel.

10. The device of claim 1, in which a load path is created on said body panel between said shoulder straps and said belt, with said load path located inward from each of said right edge and said left edge.

11. A device for carrying a child, comprising:

a flexible fabric body panel with an inside surface, an outside surface, an upper portion including an upper edge, a right edge, a left edge, and a trapezoidally shaped lower hip portion which includes a lower edge opposed to said upper edge, said lower hip portion tapered such that said lower edge is narrower in width than said body panel;

a junction of said upper portion and said lower hip portion defined by a fold, said fold being approximately 180 degrees, said inside surface positioned on said fold's inside, and said outside surface positioned on said fold's outside a hip belt, fixably attached to said body panel's outside surface, that encircles an adult wearer's waist, with an adjustable, separable buckle, with said belt fixably attached to a fraction of said lower hip portion's width between said right edge and said left edge, area of said fixable attachment being approximately rectangular in shape and positioned immediately above said fold; a right shoulder strap, with one right shoulder strap end joined to said body panel near an intersecting point of said upper edge and said right edge, and another right shoulder strap end adjustably joined to said right edge;

a left shoulder strap, with one left shoulder strap end joined to said body panel near an intersecting point of said upper edge and said left edge, and another left shoulder strap end adjustably joined to said left edge;

a right restraint strap, with one right restraint strap end attached to said lower hip portion's lower edge, and another right restraint strap end removably and adjustably attached to said body panel's right edge;

a left restraint strap, with one left restraint strap end attached to said lower hip portion's lower edge, and another left restraint strap end removably and adjustably attached to said body panel's left edge.

12. The device of claim 11, in which the device may be worn on an adult's back or an adult's front.

13. The device of claim 11, which further includes a removable hood attached to said body panel.

14. The device of claim 11, further including a sternum strap that removably and adjustably connects said right and left shoulder straps together.

15. The device of claim 11, in which at least a portion of said right and left shoulder straps are made from stretchable, 3d woven fabric.

16. The device of claim 11, in which at least a portion of said body panel is made from stretchable, 3d woven fabric.

17. The device of claim 11, in which the device is packable into a sack with an substantially cylindrical shape and dimensions not greater than seven inches by three inches by three inches.

18. The device of claim 11, in which said right and left restraint straps serve to create a reduced sized opening for a child's legs by being configured attached to said body panel.

19. The device of claim 11, in which said right and left restraint straps serve to create an enlarged sized opening for a child's legs by being configured detached from said body panel.

20. The device of claim 11, in which a load path is created on said body panel between said shoulder straps and said belt, with said load path located inward from each of said right edge and said left edge.

* * * * *